US007181029B2

(12) United States Patent
Ikeuchi et al.

(10) Patent No.: US 7,181,029 B2
(45) Date of Patent: Feb. 20, 2007

(54) SPEAKER SYSTEM FOR PICTURE RECEIVER AND SPEAKER INSTALLING METHOD

(75) Inventors: Kazuhiko Ikeuchi, Takatsuki (JP); Kazue Satoh, Neyagawa (JP); Yuichi Matsuoka, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 224 days.

(21) Appl. No.: 10/525,546

(22) PCT Filed: Aug. 6, 2004

(86) PCT No.: PCT/JP2004/011666

§ 371 (c)(1),
(2), (4) Date: Feb. 24, 2005

(87) PCT Pub. No.: WO2005/015946

PCT Pub. Date: Feb. 17, 2005

(65) Prior Publication Data

US 2005/0271227 A1 Dec. 8, 2005

(30) Foreign Application Priority Data

Aug. 7, 2003 (JP) ..... 2003-288716

(51) Int. Cl.
*H01H 43/00* (2006.01)

(52) U.S. Cl. ..... 381/306

(58) Field of Classification Search ..... 381/306, 381/17–18, 98–99, 27, 333, 300; 181/144–145

See application file for complete search history.

(56) References Cited

U.S. PATENT DOCUMENTS 4,403,112 A * 9/1983 Modafferi ..... 381/98

(Continued)

FOREIGN PATENT DOCUMENTS

JP 01-272299 A 10/1989

(Continued)

OTHER PUBLICATIONS

European Search Report for Application No. EP 04 74 8300, dated Aug. 23, 2005.
Japanese Search Report for PCT/JP2004/011666, dated Sep. 28, 2004.

*Primary Examiner*—Vivian Chin
*Assistant Examiner*—Lun-See Lao
(74) *Attorney, Agent, or Firm*—RatnerPrestia

(57) ABSTRACT

A speaker system for a picture receiver provides for lessening of the casing width of the picture receiver while assuring highly uniform acoustic characteristic at listening points in a sufficiently broad range. The speaker system for picture receiver and its speaker installing method comprises a first speaker for reproducing medium and high range sound at the right and left of the screen of a picture receiver and a second speaker for reproducing medium and low range sound under the screen, wherein the speaker system is set in such place that when a listening point is set at a position a first distance apart from the picture receiver and within a second distance from the front axis at the center of the right and left of the screen, the distance from the first speaker to the listening point is R1, the distance from the second speaker to the listening point is R2, and the crossover frequency is f, then R1, R2 and f satisfy the specified relative formula.

8 Claims, 4 Drawing Sheets

U.S. PATENT DOCUMENTS

| | | | | | |
|---|---|---|---|---|---|
| 4,860,363 | A | * | 8/1989 | Suzuki et al. | 381/89 |
| 4,991,687 | A | * | 2/1991 | Oyaba et al. | 181/145 |
| 5,181,247 | A | * | 1/1993 | Holl | 381/306 |
| 5,448,647 | A | * | 9/1995 | Koizumi | 381/388 |
| 2002/0048381 | A1 | * | 4/2002 | Tamayama | 381/307 |

FOREIGN PATENT DOCUMENTS

| | | | |
|---|---|---|---|
| JP | 272299 | | * 10/1989 |
| JP | 02-013097 | A | 1/1990 |
| JP | 2000-354285 | | 12/2000 |
| JP | 2003-354285 | A | 12/2000 |

* cited by examiner

SPEAKER SYSTEM FOR PICTURE RECEIVER AND SPEAKER INSTALLING METHOD

This application is a U.S. National Phase Application of PCT International Application PCT/JP2004/011666.

TECHNICAL FIELD

The present invention relates to a speaker system used for picture receiver and a speaker installing method.

BACKGROUND ART

A conventional speaker system for picture receiver comprises a speaker for reproducing medium and high range sound at the sides of the screen of a picture receiver and a speaker for reproducing medium and low rainge sound under the screen of the receiver. Such a conventional speaker system for picture receiver is disclosed, for example, in Japanese Laid-Open Patent 2000-354285 (page 1 to 5, FIG. 1).

FIG. 4 shows a conventional speaker system for picture receiver. The speaker system for picture receiver of FIG. 4 comprises speaker 102 for reproducing medium and high range sound at the sides of screen 101 of a picture receiver, speaker 103 for reproducing medium and low rainge sound under the screen 101, and dividing network 104. In this configuration, the volume difference between speaker 102 for medium and high range sound and speaker 103 for medium and low range sound is adjusted so that the acoustic characteristic becomes nearly uniform at a listening point on the front axis at the center of the right and left.

And, for assuring the uniform acoustic characteristic also at a listening point apart from the front axis at the center of the right and left, it is a common method that the cut-off frequencies of the speaker for medium and high range sound and the speaker for low range sound are lowered as much as possible or the positions of the speaker for medium and high range sound and the speaker for medium and low range sound are approached as much as possible.

DISCLOSURE OF THE INVENTION

A speaker system for picture receiver, comprising:

a first speaker for reproducing medium and high range sound which form a sound image nearly at the vertical center in the right and left region of the screen of a picture receiver; and a second speaker for reproducing medium and low range sound under the screen, wherein when a listening point is set at a point a first distance apart in forward direction of the screen and within a second distance from the front axis at the center of the right and the left of the screen, distance R1 from the sound source position of the first speaker to the listening point, distance R2 from the sound source position of the second speaker to the listening point, and crossover frequency f of the first speaker and the second speaker frequency-divided by dividing network satisfy the following relative equation:

$$|\exp(-j\times k\times R1)\times\exp(j\times D\times\pi/4)+(-1)^{D+1}\times\exp(-j\times k\times R2)\times\exp(-j\times D\times\pi/4)|\geqq 1/\sqrt{2},$$

$$k=2\pi\times f/c,$$

exp=exponential function, j=unit of complex number, c=sound velocity,

π=circular constant,

D=degree of dividing network (0 or positive integers).

A speaker installing method of installing a speaker system for picture receiver comprising:

a first speaker for reproducing medium and high range sound which form a sound image nearly at the vertical center in the right and left region of the screen of a picture receiver, and a second speaker for reproducing medium and low range sound under the screen, wherein the first speaker and the second speaker are installed in such place that when a listening point is set at a point a first distance apart in forward direction of the screen and within a second distance from the front axis at the center of the right and the left of the screen, distance R1 from the sound source position of the first speaker to the listening point, distance R2 from the sound source position of the second speaker to the listening point, and crossover frequency f of the first speaker and the second speaker frequency-divided by dividing network satisfy the following relative equation:

$$|\exp(-j\times k\times R1)\times\exp(j\times D\times\pi/4)+(-1)^{D+1}\times\exp(-j\times k\times R2)\times\exp(-j\times D\times\pi/4)|\geqq 1/\sqrt{2},$$

k=2π×f/c, exp=exponential function, j=unit of complex number, c=sound velocity,

π=circular constant,

D=degree of dividing network (0 or positive integers).

DETAILED DESCRIPTION OF THE PREFERRED EMBODIMENTS

However, in the conventional configuration, the acoustic characteristic is uniform at a listening point on the front axis at the center of the right and the left, but in case the frequency of the dividing network is too high, the range of service area that can be provided with the acoustic characteristic is not clear. Accordingly, there is no other method than actually setting up the system each time and checking it by the auditory sense.

Actually, for the purpose of setting a relatively wide service area before making the system, as described above, a method generally employed is such that a frequency lower than 200 Hz having no directivity is used as the cut-off frequency of a speaker for medium and high range sound and a speaker for low range sound, or the positions of the speaker for medium and high range sound and the speaker for medium and low range sound are arranged as much closer to each other as possible. However, if the cut-off frequency is set lower, it will become necessary to use large-sized speakers for medium and high range sound at the sides of the picture receiver. Also, if the speaker for low-pitched sound is approached to the speaker for medium and high range sound located at the sides of the picture receiver, a large space will become necessary as a place for installing both speakers.

Since a sound image is formed at a position close to the speaker for medium and high range sound having high sensitivity because of the human auditory sense, it is desirable to install the speaker for medium and high range sound at the vertical center of the screen in order to form the sound image at a position close to the center of the screen. However, in the above configuration, a large space is required for installing a speaker for medium and high range sound. Therefore, it becomes very difficult to lessen the casing width of the picture receiver.

The present invention is intended to solve the conventional problem, and the object is to obtain the relationship between the optimum speaker position in a specified audio-visual area and the frequency of dividing network in order that the positions of a speaker for medium and high range sound and a speaker for medium and low range sound and the cut-off frequency satisfy the relative equation, thereby making it easy to decide each element. Also, even when the cut-off frequency is set to an incredibly high value, it is possible to decide each element so that highly uniform acoustic characteristic can be assured at listening points in a sufficiently broad range. Also, even when a speaker for medium and high sound and a speaker for medium and low sound are spaced incredibly apart from each other, it is possible to determine each element so that highly uniform acoustic characteristic can be assured at listening points within a broad range.

The preferred embodiments of the present invention will be described in the following with reference to the drawings.

(Preferred Embodiment 1)

Figure 1:
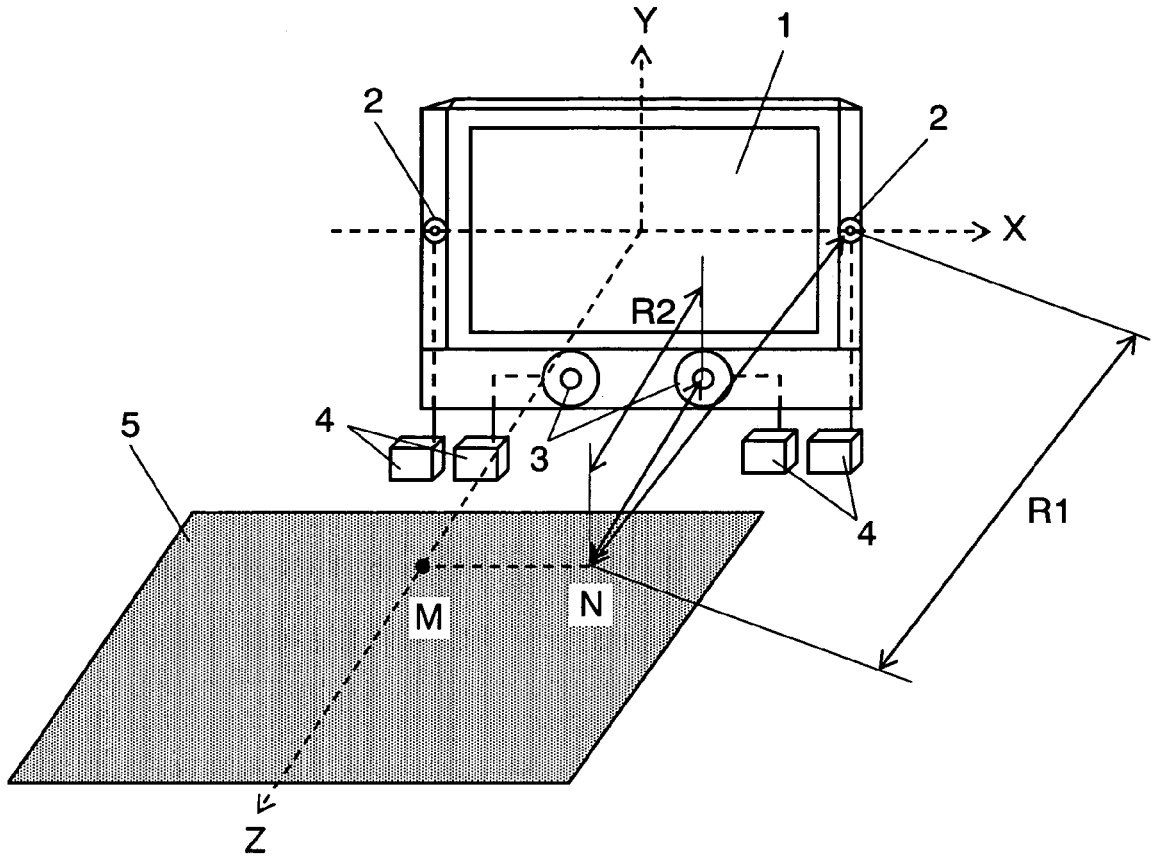
FIG. 1 is a block diagram of a speaker system in one preferred embodiment of the present invention.

FIG. 1 is a diagram showing the configuration of a speaker system for picture receiver in the preferred embodiment 1 of the present invention. In FIG. 1, mid-high range speaker 2 is installed nearly at the vertical center of screen 1 in the right and left region of screen 1 of a picture receiver, and mid-low range speaker 3 is installed under the screen 1. In this configuration, since only the mid-high range speaker smaller in size is installed at the right and left of screen 1 while forming a sound image nearly at the center of the screen, it is possible to lessen the casing width of the picture receiver.

Dividing network 4 serves to divide the audio frequency range generated from mid-high range speaker 2 and the audio frequency range generated from mid-low range speaker 3, and therefore, it usually comprises a high-pass filter and a low-pass filter. The cut-off characteristic crossing frequency of each filter is called crossover frequency. The crossover frequency is adjusted in accordance with the characteristic of the speaker used. Here, if intended to reduce the size of mid-high range speaker 2, it is necessary to set the crossover frequency higher. Generally, if it is possible to set the crossover frequency higher than 200 Hz, a sufficiently small-sized speaker can be used and it will greatly save the space.

Next, listening point M is set at a position a first distance apart from screen 1 in the forward direction (Z-axis direction in FIG. 1) of the screen from the picture receiver. Presently, there is an increasing trend of extra-fine and high-quality pictures, and wider screens with aspect ratio of 16:9. Accordingly, the speaker system must be set in anticipation of such tendency that the audience may enjoy really impressive pictures from near a wide screen displaying extra-fine and high-quality pictures. Because of such background, as the first distance, for example, being a distance three times the vertical size of screen 1, listening point M is set at a position spaced apart by this distance. Next, listening point N is set at a position a second distance apart from the front axis (Z axis in FIG. 1) at the center of the right and left of screen 1. As the second distance, for example, it is set to 1 m. This distance is set in anticipation of such situations that the audience includes a plurality of persons and that the audience moves while watching the pictures.

Since a common-type large television set is anticipated in setting the second distance, it is preferable to set the distance in accordance with the type of picture receiver. Also, it is possible to set the second distance to a value different from the above depending upon the picture quality, sound quality, and type of picture receiver.

Further, in the speaker system of the present invention, the right and left positions (positions in the X-axis direction in FIG. 1) of mid-low range speakers 3 are determined as follows.

First, the distance between mid-high range speaker 2 and listening point N is R1. Similarly, the distance between mid-low range speaker 3 and listening point N is R2. When the crossover frequency is f and the degree of dividing network is D as described above, the speaker is designed and each speaker is installed so that the formula such as $$|\exp(-j\times k\times R1)\times\exp(j\times D\times\pi/4)+(-1)^{D+1}\times\exp(-j\times k\times R2)\times\exp(-j\times D\times\pi/4)|\geqq 1/\sqrt{2} \quad \text{(formula 1)}$$

$$k=2\pi\times f/c \quad \text{(formula 2)}$$

is satisfied. For example, the value of R2 is decided by using R1 that is decided nearly in single meaning with the size of screen 1 decided, and f of which the optimum value is decided by the characteristic of the speaker used. Since the formula 1 is inequality, R2 is represented as a value having a specific range.

Next, under the structural limit of configuration, the portion where a mid-low range speaker can be installed in the lower region of screen 1 is decided. For example, in the case of a television set using a cathode-ray tube, it cannot be installed on a portion where a column is disposed to support a heavy cathode-ray tube. Or, it cannot be installed on a portion where a remote control receiver or operation button or the like is disposed. And with the installing portion decided, mid-low range speaker 3 is installed thereon in a position where R2 is satisfied.

The operation of a speaker system having the above configuration will be described in the following.

First, mid-high range speaker 2 and mid-low range speaker 3 are adjusted so that the acoustic characteristic becomes uniform at listening point M with respect to the volume difference at the audible frequency. In this way, the uniformity of acoustic characteristic at listening point M can be assured.

However, the uniformity of acoustic characteristic cannot be assured at points other than the listening point that is the reference point for the adjustment. This is because when a sound of same frequency is generated from different sound sources, if the distance from each sound source to the listening point is changed, it will cause the generation of attenuation due to phase difference as the difference in distance turns into difference in sound wave phase. When the frequency is low or high enough, the sound is produced from only one of the speakers due to dividing network 4, and there arises no such problem. However, in the vicinity of the crossover frequency, the problem is remarkable because the sound is produced from both of the speakers.

In order to solve this problem, in the range where it is anticipated that the audience hears the attenuation at the crossover frequency, in case the attenuation is 0 dB without depending upon distance on the central axis of two speakers, it is preferable to be kept within −3 dB. Attenuation of −3 dB means that the sound is attenuated to half the energy of original sound. Generally, the human auditory sense is able to sense incongruity when the energy of sound becomes lower than half the energy of original sound. From this point of view, it can be judged that the uniformity of acoustic characteristic can be obtained when the attenuation is about −3 dB in actual use.

Here, the background and meaning of establishing (formula 1) will be briefly described in the following.

In (formula 1), k×R1 of exp(−j×k×R1) corresponds to the value of distance from mid-high range speaker 2 to listening point N represented by sound wave phase, taking into account the relation of (formula 2). Accordingly, exp(−j×k×R1) of formula 1 is a phase lag generated before the sound of frequency f produced from mid-high range speaker 2 reaches the listening point N.

Incidentally, dividing network 4 is inserted between the output circuit of audio signal and mid-high range speaker 2, and the audio signal is fed to mid-high range speaker 2 via dividing network 4.

Dividing network 4 serves to separate the audio signal fed to mid-high range speaker 2 from the audio signal fed to mid-low range speaker 3 on the frequency axis. Generally, a high-pass filter of D degree and a low-pass filter of D degree are formed through dividing network 4. The system of mid-high range speaker 2 comprises a high-pass filter of D degree, and the system of mid-low speaker 3 comprises a low-pass filter. "D" is 0 or positive integers. Usually, mid-high range speaker 2 and mid-low range speaker 3 are considered to be pure resistance, and the output impedance of audio signal output circuit can be considered to be pure resistance of small value. There exist a circuit for mid-high range speaker 2 and a circuit for mid-low range speaker 3 in dividing network 4. When "D" is 1, the circuit for mid-high range speaker 2 is formed of a capacitor inserted in series fashion to mid-high range speaker 2, and the circuit for mid-low range speaker 3 is formed of an inductor inserted in series fashion to mid-low range speaker 3. That is, the system of mid-high range speaker 2 is equivalent to a 1st-order advance circuit in the vicinity of cut-off frequency, and the system of mid-low range speaker 3 is equivalent to a 1st-order lag circuit in the vicinity of cut-off frequency. Generally, the cut-off frequency of mid-high range speaker 2 and the cut-off frequency of mid-low range speaker 3 are set at same level. The cut-off frequency corresponds to crossover frequency f.

Incidentally, since there exists dividing network 4 between the output circuit of audio signal and mid-high range speaker 2, the sound produced from mid-high range speaker 2 has a first order phase lead at crossover frequency f. That is, the phase leads by π/4 phase. Exp(j×π/4) of (formula 1) represents this phase lead.

Consequently, when the sound produced from mid-high range speaker 2 reaches the listening point N, the phase shift is the product of exp(−j×k×R1) and exp(j×π/4). That is, it corresponds to exp(−j×k×R1)×exp(j×π/4) in (formula 1).

On the other hand, taking into account the relation of (formula 2), k×R2 of exp(−j×k×R2) of (formula 1) corresponds to the value of sound wave phase that represents the distance from mid-low range speaker 3 to the listening point N. Accordingly, exp(−j×k×R2) of formula 1 is a phase lag generated before the sound of frequency f produced from mid-low range speaker 3 reaches the listening point N.

There exists dividing network 4 between the output circuit of audio signal and mid-low range speaker 3. When degree "D" is supposed to be 1, the sound produced from mid-low range speaker 3 has a first order phase lag at crossover frequency f. That is, the phase lags by π/4. Exp(−j×π/4) of (formula 1) represents this phase lag.

Consequently, when the sound produced from mid-low range speaker 3 reaches the listening point N, the phase shift is the product of exp(−j×k×R2) and exp(−j×π/4). That is, it corresponds to exp(−j×k×R2)×exp(−j×π/4) in (formula 1).

Incidentally, the sound at listening point N is the sound obtained when the sound that is produced from mid-high range speaker 2 and reaches the listening point N is synthesized with the sound that is produced from mid-low range speaker 3 and reaches the listening point N. That is, the synthesized sound reaching the listening point N can be represented by (formula 3).

$$\exp(-j\times k\times R1)\times\exp(j\times\pi/4)+\exp(-j\times k\times R2)\times\exp(-j\times\pi/4) \quad \text{(formula 3)}$$

Since the amplitude of sound reaching the listening point N corresponds to the absolute value of (formula 3), the amplitude of sound reaching the listening point N can be represented by (formula 4).

$$|\exp(-j\times k\times R1)\times\exp(j\times\pi/4)-\exp(-j\times k\times R2)\times\exp(-j\times\pi/4)| \quad \text{(formula 4)}$$

Formula 4 supposes that the value of degree "D" is 1. In the present invention, degree "D" is not limited to 1. When the degree is 0 or variable "D" as positive integer, since there exists dividing network 4 of degree "D" between the output circuit of audio signal and mid-high range speaker 2, the sound produced from mid-high range speaker 2 has a D order phase lead at crossover frequency f. That is, the phase leads by D×π/4. Since there exists dividing network 4 of degree "D" between the output circuit of audio signal and mid-low range speaker 3, the sound produced from mid-low range speaker 3 has a D order phase lag at crossover frequency f. That is, the phase lags by D×π/4. Accordingly, when the order is "D", (formula 4) becomes (formula 5). In the case of even number, exp(j×π/4) and exp(−j×π/4) are reversed in phase, and therefore, (formula 4) holds good taking into account the case of even number.

$$|\exp(-j\times k\times R1)\times\exp(j\times D\times\pi/4)+\exp(-j\times k\times R2)\times\exp(-j\times D\times\pi/4)| \quad \text{(formula 5)}$$

Formula 5 is the left side of (formula 1), and the right side of (formula 1) represents −3 dB in the form of fractions.

As described above, the speaker system satisfies the formula 1, thereby assuring the uniformity of acoustic characteristic within −3 dB.

And, the uniformity of acoustic characteristic can be assured between listening point M and listening point N. At positions going away from listening point M with respect to screen 1, the uniformity of acoustic characteristic is assured because the difference between the distances from the two sound sources is reduced. Thus, due to the configuration of the present invention, it is possible to realize an audio-visual area necessary for regeneration of highly uniform acoustic characteristic in accordance with the screen size of a picture receiver.

Figure 2:
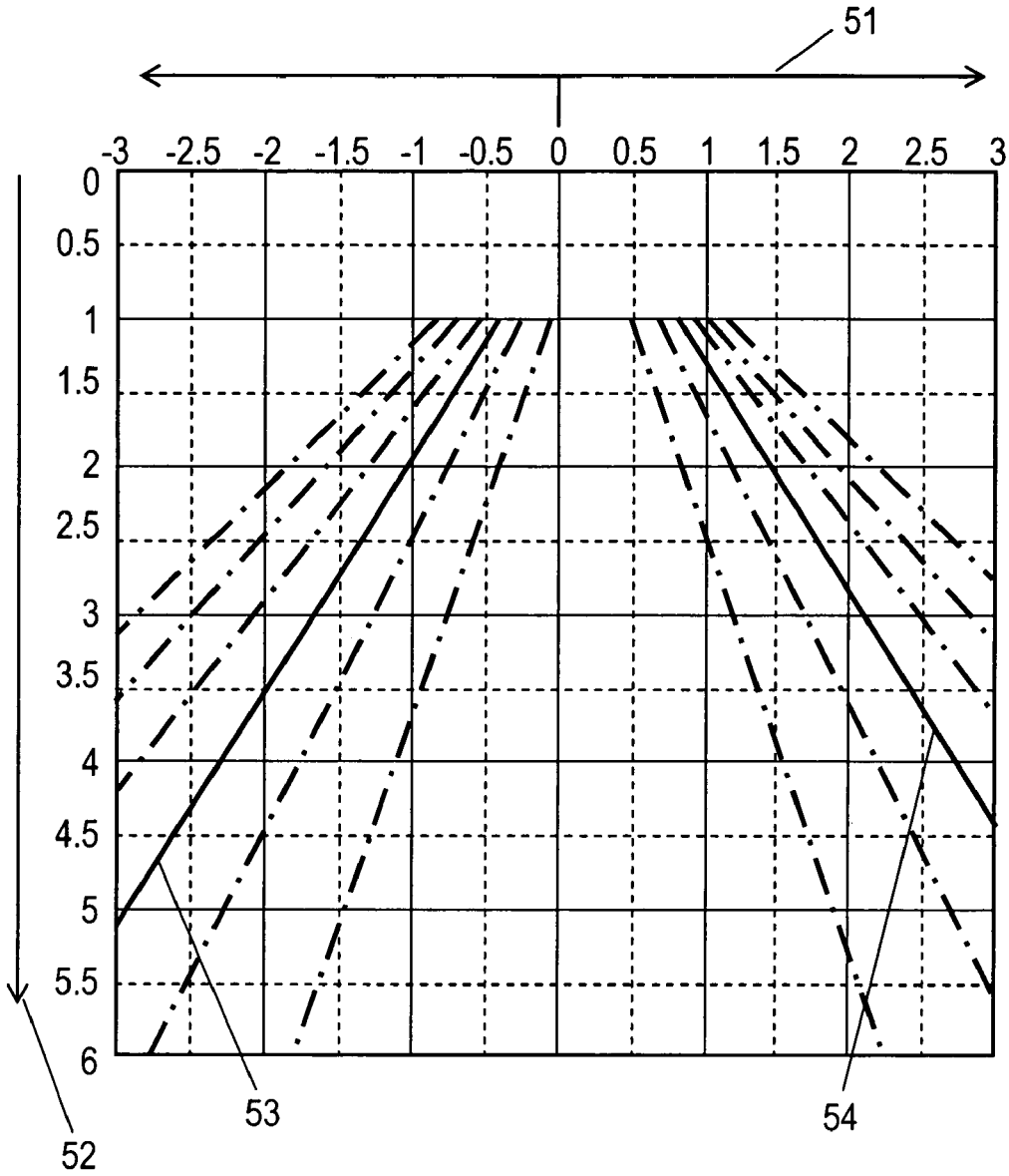
FIG. 2 is a sound pressure distribution diagram of an audio-visual area, supposing that the screen size is 37 inches in FIG. 1.

Next, in FIG. 2, the sound pressure distribution in 16:9 display of 37 inch configured on the basis of (formula 1) is simulated by computer. The size is supposed to be the largest of all in display using CRT. The larger the screen, the sound source position is more remote and it becomes more difficult to assure the uniformity of acoustic characteristic.

In this simulation, crossover frequency f is first set to 500 Hz. This frequency is more advantageous in such point that a smaller speaker is used, but the value is disadvantageous for assuring the uniformity of acoustic characteristic.

Further, same as the relation of FIG. 1, the origin is set at the center of screen 1 of a picture receiver. And, mid-high range speaker 2 is arranged at a position 0.455 meters in X-axis direction and 0 meter in Y-axis direction. Also, mid-low range speaker 3 is arranged at a position 0.22 meter in X-axis direction and 0.3 meter in Y-axis direction corresponding to the position of R2 that satisfies (formula 1).

The results of simulation under the above conditions are shown by a plurality of lines in FIG. 2. Horizontal axis 51 of the graph is the distance in X-axis direction from the origin set at the center of screen 1, and vertical axis 52 is the distance going away in forward direction from the screen. The whole plane corresponds to a view from above audio-visual area 5 in FIG. 1. Also, each oblique line shows the line of point of attenuation 1 dB each from the front axis at the center of screen 1 of the picture receiver at the set frequency. Particularly, the lines of attenuation 3 dB are shown by solid lines 53, 54, and the others are shown by dotted lines.

It is clear that the more going outside the graph, the more the sound pressure is uniformly attenuated. Thus, since the screen height of the picture receiver is 0.46 meters, listening point M is at the position of 1.38 meters, showing that the position of 1 meter in the X-axis direction therefrom corresponds to the line of sound pressure (−3 dB) of about $\sqrt{1/2}$. Also, it shows that the region of attenuation of within 3 dB is sufficiently assured.

Figure 3:
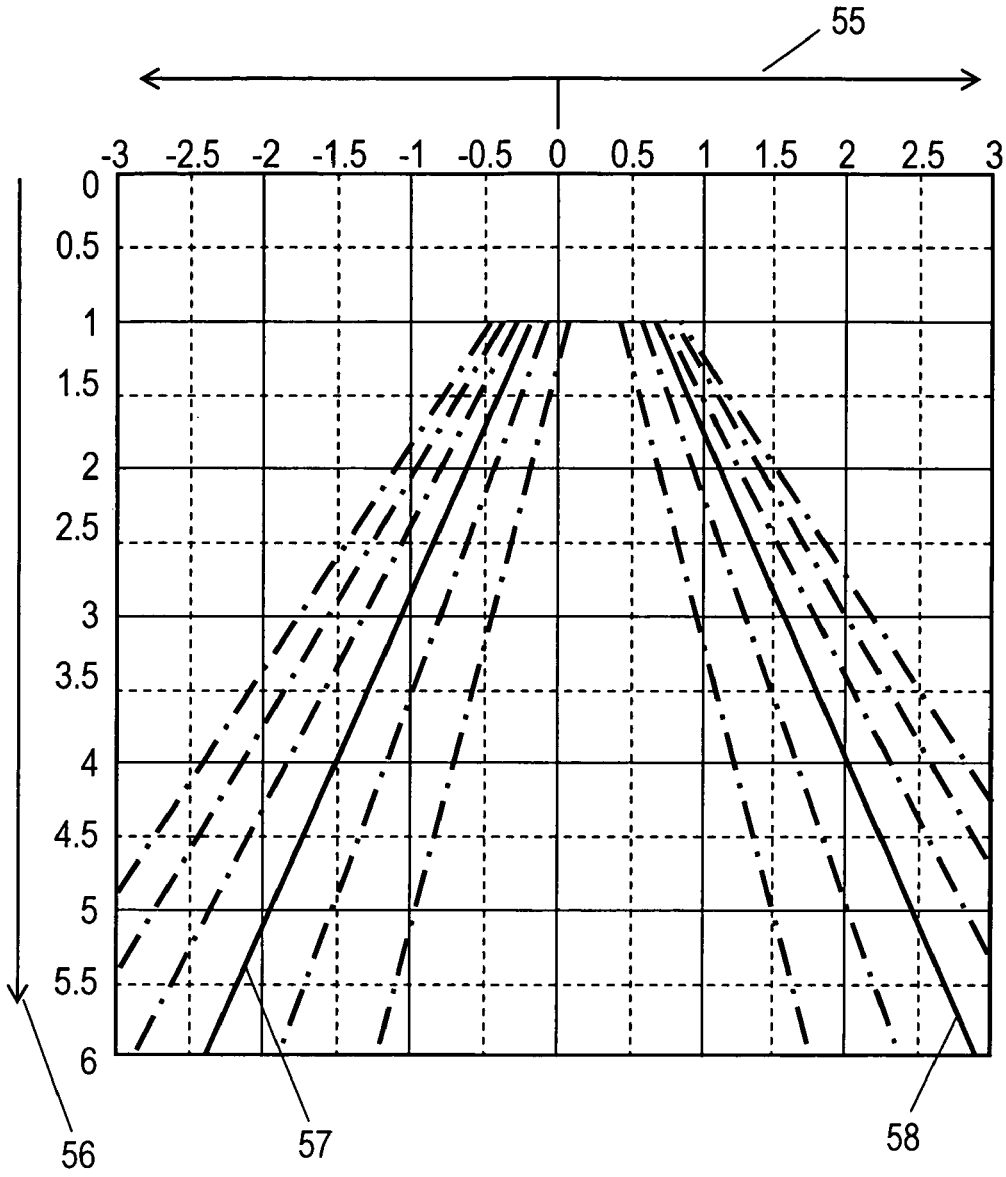
FIG. 3 is a sound pressure distribution diagram of an audio-visual area, supposing that the screen size is 50 inches in FIG. 1.
Figure 4:
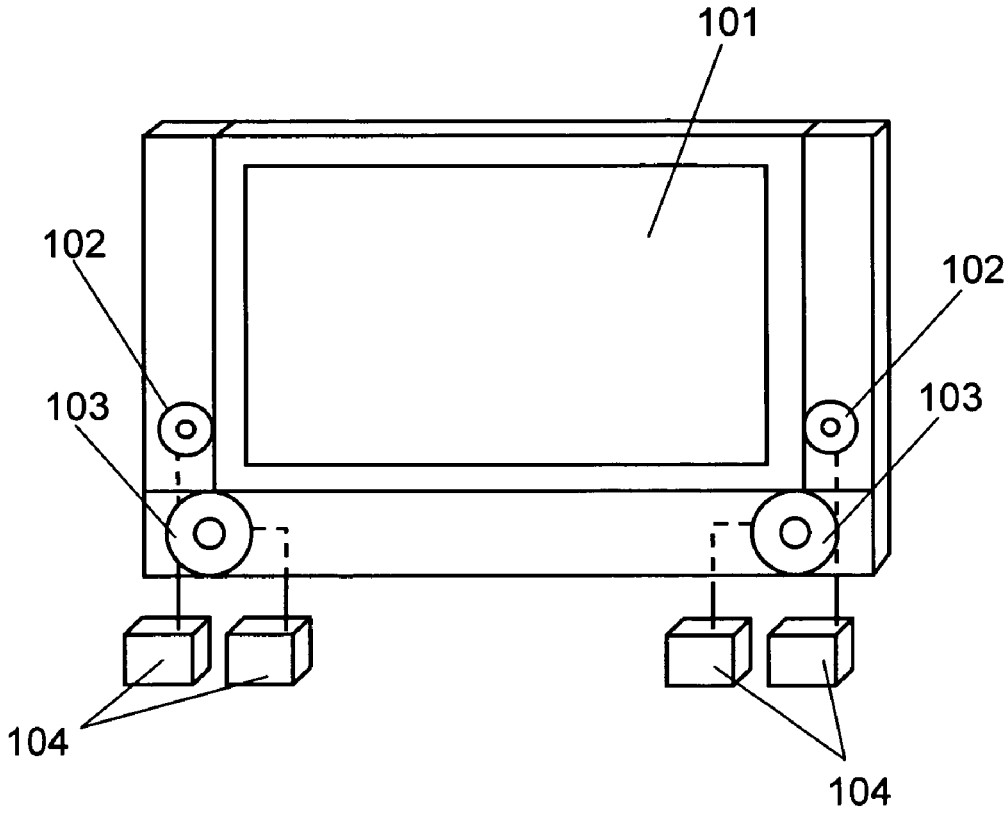
FIG. 4 PRIOR ART
FIG. 4 is a block diagram of a conventional speaker system.

Similarly, in FIG. 3, the sound pressure distribution in audio-visual area 5 in 16:9 display of 50 inch is simulated by computer. The size is supposed to be that of display using PDP, and the screen is larger than the one shown in FIG. 2, and further, it is difficult to assure the uniformity of acoustic characteristic.

In this case, mid-high range speaker 2 is arranged at a position 0.615 meter in X-axis direction and 0 meter in Y-axis direction from the center of screen 1 of the picture receiver. As a position corresponding to R2 that satisfies (formula 1), mid-low range speaker 3 is arranged at a position 0.25 meter in X-axis direction and −0.385 meter in Y-axis direction from the center of screen 1 of the picture receiver. Crossover frequency f is 500 Hz the same as in FIG. 2.

Under the condition of FIG. 3, the same as in FIG. 2, the more going outside the graph, the more the sound pressure is uniformly attenuated. Each oblique line shows the line of point of point of attenuation 1 dB each from the front axis at the center of screen 1 of the picture receiver at the set frequency. Particularly, the lines of attenuation 3 dB are shown by solid lines 57, 58, and the others are shown by dotted lines. Since the screen height of the picture receiver is 0.622 meter, listening point M is at the position of 1.866 meters in the direction of vertical axis 56, showing that the position of 1 meter in the X-axis (horizontal axis 55) direction therefrom corresponds to the line of sound pressure (−3 dB) of about $\sqrt{1/2}$. Also, it shows that the region of attenuation of within 3 dB is sufficiently assured the same as in FIG. 2.

As described above, arranging only a small-sized mid-high range speaker nearly at the vertical center of the screen in the right and left region of the screen of the picture receiver, it is possible to lessen the casing width of the picture receiver as much as possible while forming the sound image in the vicinity of the screen. As is obvious from the result of simulation, setting f, R1, R2 and D in such relations that (formula 1) is satisfied, it is possible to realize an audio-visual area necessary for the regeneration of highly uniform acoustic characteristic in accordance with the screen size of the picture receiver.

In the preferred embodiment of the present invention, the case of setting R2 that satisfies the relative formula from f and R1 has been described. It is also preferable to set R1 and R2 beforehand provided that the relative formula is satisfied and to set the dividing network by obtaining, from the relative formula, crossover frequency f that realizes an audio-visual area for regeneration of highly uniform acoustic characteristic in such positional relations.

Also, described above is such a case that mid-high range speaker 2 is formed of a single speaker, but it is also preferable to arrange two or more speakers in the right and left region of the screen of the picture receiver so that the overall sound image is positioned nearly at the vertical center of the screen. In this case, it is defined that the first speakers for reproducing medium and high range sound comprise two or more speakers.

Also, one example of the present invention shown in FIG. 2 and FIG. 3 refers to mid-high range speaker and mid-low range speaker located at the normal position in X-axis direction in FIG. 1, but naturally when the speaker system is arranged in a stereophonic fashion, the speaker system of the present invention can be applied to both of the right and left speaker systems.

As is obvious in the above description, the speaker system for picture receiver and the speaker installing method of the present invention are able to lessen the casing width of the picture receiver while realizing an audio-visual area necessary for regeneration of high uniform acoustic characteristic in accordance with the screen size of the picture receiver.

Also, since the audio-visual area can be previously calculated from the relations of the speaker position and the dividing network frequency, it is possible to lessen the casing width of the picture receiver as much as possible while realizing a minimum necessary audio-visual area in accordance with the screen size of the picture receiver.

In this preferred embodiment, the crossover frequency is 500 Hz in the description, but nearly same effect can be obtained with the crossover frequency set to 400 Hz, 600 Hz or the like. In the case of a speaker capable of reproducing 200 Hz or over, the casing width required is 40 mm at least. However, in the case of a speaker capable of reproducing only 400 Hz or over, the width can be decreased to 20 mm at least. Accordingly, setting the crossover frequency to 400 Hz to 600 Hz, the size of mid-high range speaker can be lessened and highly uniform acoustic characteristic can be assured at listening points in a sufficiently broad range, and also, the casing width of the picture receiver can be lessened. Thus, it is possible to enhance the freedom of design.

INDUSTRIAL APPLICABILITY

The speaker system for picture receiver and the speaker installing method of the present invention are able to lessen the casing width of the picture receiver while realizing an audio-visual area necessary for regeneration of highly uniform acoustic characteristic in accordance with the screen size of the picture receiver. The speaker system for picture receiver of the present invention is useful as a monitor speaker system for a screen projection type display, organic EL, and liquid crystal display as well as a display using CRT or PDP. Also, it can be used as a monitor speaker system for shop front display.

The invention claimed is:

1. A speaker system for picture receiver, comprising:

a first speaker for reproducing medium and high range sound which form a sound image nearly at the vertical center in the right and left region of the screen of a picture receiver; and a second speaker for reproducing medium and low range sound under the screen, wherein when a listening point is set at a point a first distance apart in forward direction of the screen and within a second distance from the front axis at the center of the right and the left of the screen, distance R1 from the sound source position of the first speaker to the listening point, distance R2 from the sound source position of the second speaker to the listening point, and crossover frequency f of the first speaker and the second speaker frequency-divided by dividing network satisfy the following relative formula:

$$|\exp(-j\times k\times R1)\times\exp(j\times D\times\pi/4)+(-1)^{D+1}\times\exp(-j\times k\times R2)\times\exp(-j\times D\times\pi/4)|\geqq 1/\sqrt{2},$$

$$k=2\pi\times f/c,$$

exp=exponential function, j=unit of complex number, c=sound velocity,

π=circular constant,

D=degree of dividing network (0 or positive integers).

2. The speaker system for picture receiver of claim 1, wherein the second distance is 1 m, the crossover frequency f is 200 Hz or over, and the second speaker satisfies the relative formula.

3. The speaker system for picture receiver of claim 1, wherein the first distance is three times the vertical size of the screen.

4. The speaker system for picture receiver of claim 1, wherein the crossover frequency f is not lower than 400 Hz and not higher than 600 Hz.

5. A speaker installing method of installing a speaker system for picture receiver comprising:

a first speaker for reproducing medium and high range sound which form a sound image nearly at the vertical center in the right and left region of the screen of a picture receiver, and a second speaker for reproducing medium and low range sound under the screen, wherein the first speaker and the second speaker are installed in such place that when a listening point is set at a point a first distance apart in forward direction of the screen and within a second distance from the front axis at the center of the right and the left of the screen, distance R1 from the sound source position of the first speaker to the listening point, distance R2 from the sound source position of the second speaker to the listening point, and crossover frequency f of the first speaker and the second speaker frequency-divided by dividing network satisfy the following relative formula:

$$|\exp(-j\times k\times R1)\times\exp(j\times D\times\pi/4)+(-1)^{D+1}\times\exp(-j\times k\times R2)\times\exp(-j\times D\times\pi/4)|\geqq 1/\sqrt{2},$$

$$k=2\pi\times f/c,$$

exp=exponential function, j=unit of complex number, c=sound velocity,

π=circular constant,

D=degree of dividing network (0 or positive integers).

6. The speaker installing method of installing a speaker system for picture receiver of claim 5, wherein the second distance is 1 m and the crossover frequency f is 200 Hz or over.

7. The speaker installing method of installing a speaker system for picture receiver of claim 5, wherein the first distance is three times the vertical size of the screen.

8. The speaker installing method of installing a speaker system for picture receiver of claim 5, wherein the crossover frequency f is not lower than 400 Hz and not higher than 600 Hz.

* * * * *